United States Patent [19]

Mach

[11] 3,971,275

[45] July 27, 1976

[54] NESTABLE DIE ALIGNMENT MEANS FOR PUNCH PRESS MACHINES

[76] Inventor: John J. Mach, 2126 S. Kenilworth Ave., Berwyn, Ill. 60402

[22] Filed: Sept. 18, 1975

[21] Appl. No.: 614,705

[52] U.S. Cl. ..... 83/140; 83/54; 83/454; 83/635; 83/637

[51] Int. Cl.[2] ..... B26F 1/14

[58] Field of Search ..... 83/54, 140, 382, 454, 83/456, 635, 637, 685

[56] References Cited

UNITED STATES PATENTS 3,234,838 2/1966 Faull ..... 83/454

*Primary Examiner*—J. M. Meister

*Attorney, Agent, or Firm*—McCaleb, Lucas & Brugman

[57] ABSTRACT

Novel nesting apparatus for aligning separable die set halves of the type having demountable die insert means and utilized in punch press machines which novel apparatus is operable upon cyclic engagement of the die set halves to effect nestable reception of projecting means on one die set half within mating means on the other die set half. The novel nesting apparatus assures accurate alignment of the respective punch and die means during the positioning, clamping, and punching of variously shaped workpieces introduced therein. No auxiliary alignment means is required.

3 Claims, 5 Drawing Figures

Fig. 1.
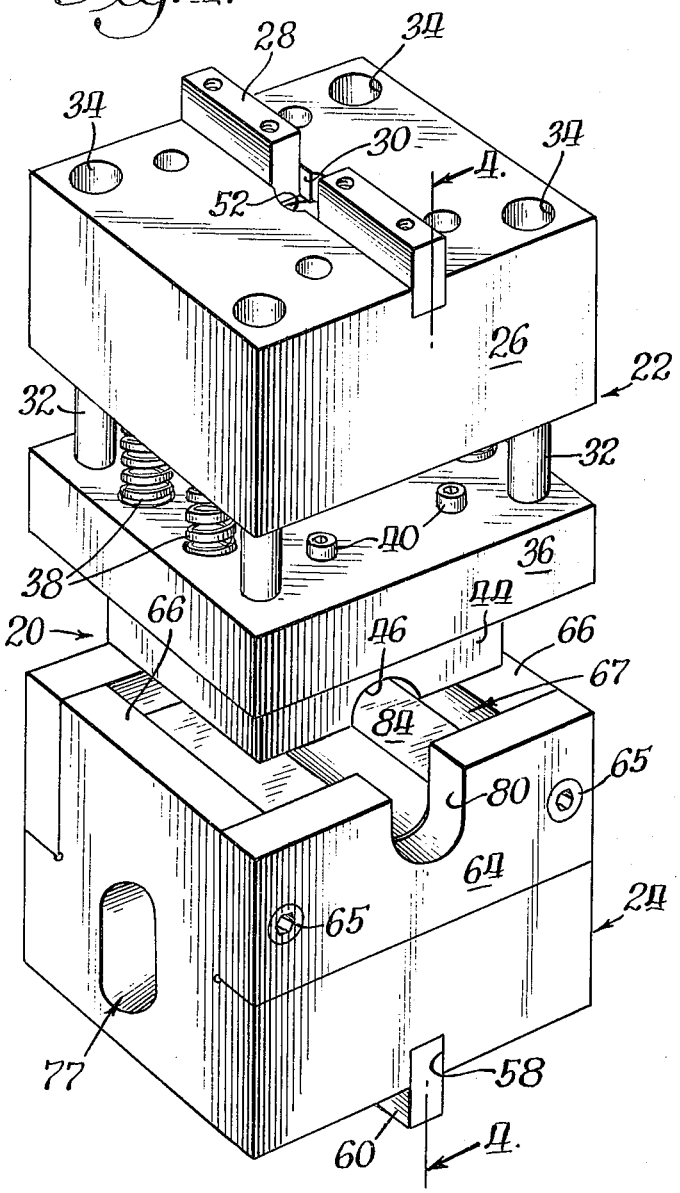
Fig. 2.
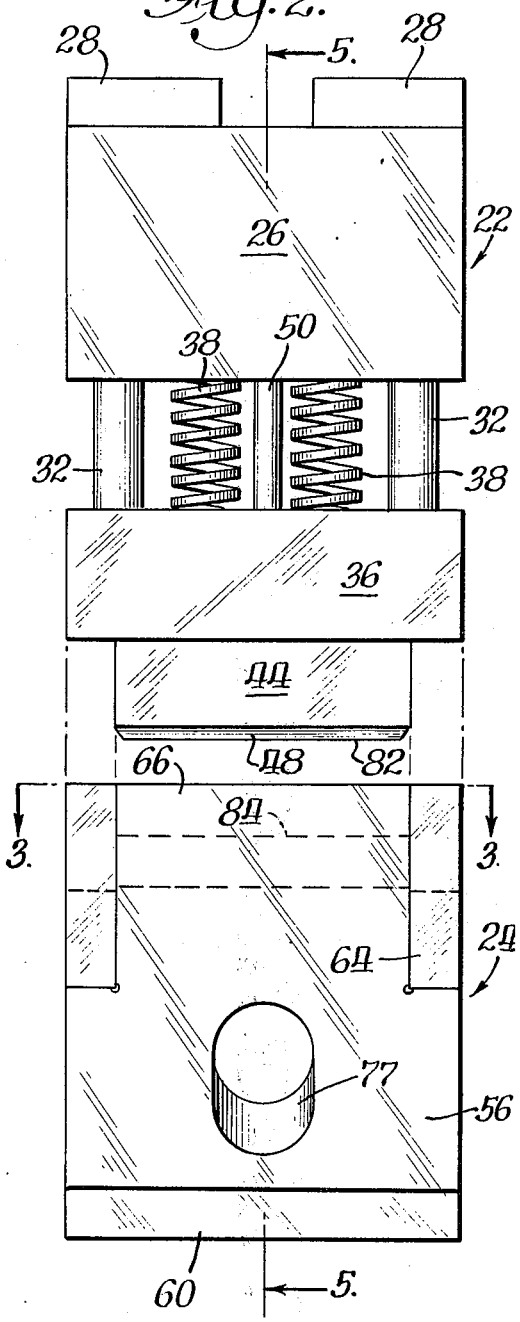
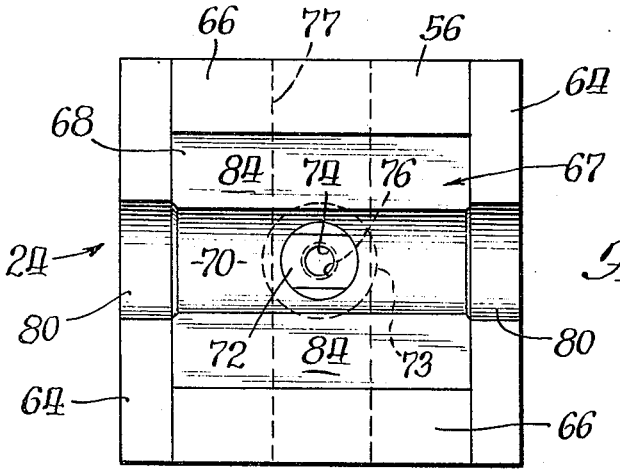
Fig. 3.

NESTABLE DIE ALIGNMENT MEANS FOR PUNCH PRESS MACHINES

BACKGROUND OF THE INVENTION

This invention relates generally to separable die set halves for punch press machines, and more particularly to alignment apparatus for such die sets, such as those utilized in tube piercing machines.

DESCRIPTION OF THE PRIOR ART

Because of the undesirable freedom and relative slack found in the ram slide of commercially available punch press machines, viz. freedom between the press' ram and bolster plate, die sets or sub-presses are used. Typically, both halves of a die set will contain releasably demountable mating die inserts to facilitate positioning and clamping of the workpiece during die set engagement thereabout, and at least one punch to pierce the hole. A primary function then of a die set is to assure some degree of alignment accuracy for the punch, and for the die inserts, when punching or piercing holes, or other shaped apertures, such as in metal workpieces. When only one punch is utilized, such as for punching through pre-blanked, flat workpieces or through workpieces having two walls (rectangular or tubular shapes, for example), a die button is carried on the die insert opposite the die set half which carries the punch so as to cooperatively effect cleanly punched holes. Accordingly, accurate punch-to-die button alignment must be assured. Sometimes, two oppositely-directed punches are used to pierce a tubular workpiece from both sides, such as in a press with limited shut-height. In view of the above operational considerations, a punch press' die set halves must be carefully aligned for continuous cyclic engagement, since their misalignment will wear down or chip the punch's cutting edges, or the die button, or the die inserts.

When utilizing different contours of die inserts to accommodate other than round workpiece configurations (such as channel sections, angle iron, square or rectangular tube), or for metallic workpieces of a heavy gauge, die set alignment is especially critical. This is because extreme pressures are exerted on the punch as it pierces the aperture in the workpiece. If continuous, accurate alignment is not assured for such extreme pressure and use conditions, either the punch and die button will wear or workpiece burrs will build up, both of which will break the punch in time, and which will certainly occur sooner than is reasonably expected.

One specific die set alignment structure is disclosed in U.S. Pat. No. 3,234,838, used for a tube piercing machine. There, the die set half alignment apparatus utilizes alignment pins and mating alignment holes. However, many undesirable problems were encountered by the art's use of the alignment apparatus taught by that patent. Only after the die set halves of that patent's tube piercing machine were physically engaged, i.e., alignment pin inserted and seated into the mating hole, did the disclosed alignment apparatus satisfactorily assure mating die insert alignment, and thus punch-to-die button alignment. However, after die set separation, the accurate engagement of the alignment apparatus was a particular problem. In fact, utilization of such pin and mating hole alignment apparatus in extreme punch press operations (such as for the expected lifetime of a die set or a million strokes, for example) gave unsatisfactory results.

Because of the aforementioned freedom between the ram head and bolster plate, such prior art alignment pins and mating holes could repetitively engage one another in an offset fashion. Such continuous non-aligned engagement tended to wear out and widen the locating hole thereby causing inaccurate alignment between die set halves. The latter in turn caused either inaccurately punched holes at the least or misalignment of the punch and die button, which it will be remembered oftentimes resulted in wear or breakage to both parts. Workpiece burrs were also found to develop under punch-to-die misalignment; this burr problem further compounded punch wear and its eventual breakage. Oftentimes, after only 50 or a 100,000 strokes, for example, of such a prior art device, the alignment holes and pins would be so worn that the complete replacement or reconstruction of the expensive die sets, not just the normally expected punch replacement, was required. It is also to be noted that in such prior art devices the only circumferential bearing areas (for lateral die set alignment purposes) occurred at the limited bearing surfaces between the alignment pins and mating holes.

SUMMARY OF THE INVENTION

The present invention provides novel accurate alignment apparatus for separable die set halves used in punch press machines, and is particularly useful for tube piercing machines. There is provided a nestable alignment means comprising a projecting die insert means on one die set half which is nestably received by the other die set half during cyclic punching operations. Besides assuring continuous accurate die set alignment, such a nestable alignment apparatus provides a large circumferential bearing area between mating alignment structure resulting in greater die set life, better quality punched workpieces, and reduced punch and die button wear. The nestable alignment means of the present invention is compatable with the demountable die insert features of commercially available die sets, as well as with standard fixed-die die sets.

Thus, this invention has as a general object the provision of cooperative alignment means for each half of a punch press die set capable of accurately nestably interfitting during cyclic engagement thereof.

As another object, the present invention provides die set alignment means having a large circumferential bearing area capable of assuring the desired longevity of die set operation.

As still another object, the present invention provides a die set alignment means being relatively maintenance free and further capable of extending normal punch and die button life thereby reducing need for expensive repairs and punch press machine down time.

The means by which the foregoing and other objects of the present invention are accomplished and the manner of their accomplishment will be readily understood by the following specification upon reference to the accompanying drawings, in which:

FIG. 1 is a perspective view (from the front, top, and side) of the punch press die set embodying the present invention, with the die set halves shown in separated relation;

FIG. 2 is a side view of the device shown in FIG. 1, again with the die set halves separated;

FIG. 3 is a plan view of the lower die set half of FIG. 2 generally corresponding to line 3—3 thereof;

DESCRIPTION OF THE PREFERRED EMBODIMENT

Figure 4:
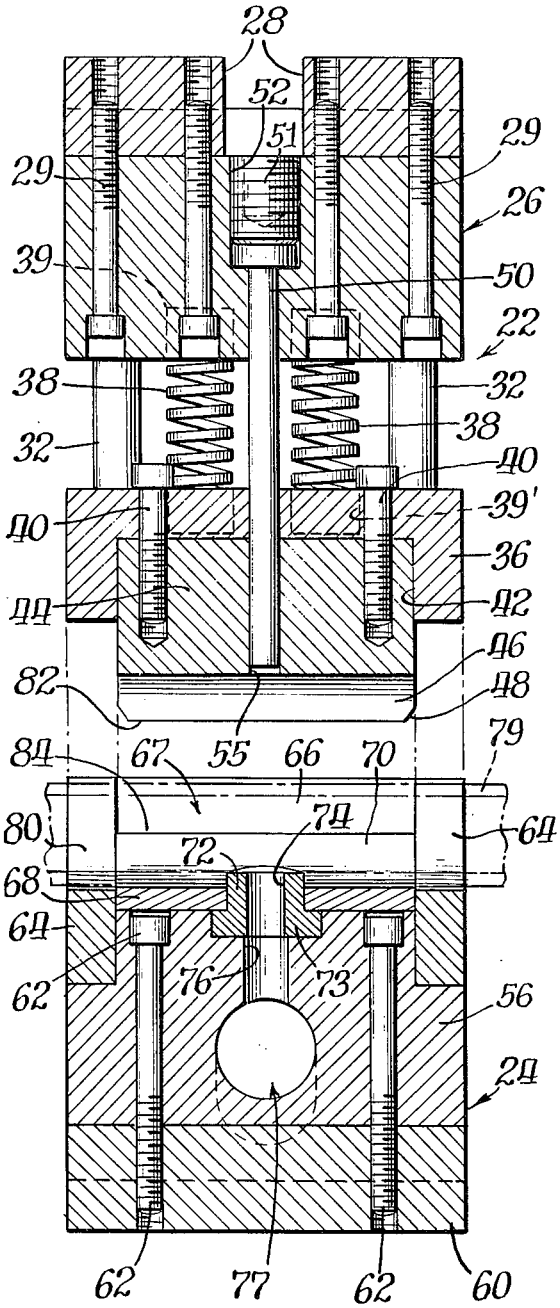
FIG. 4 is a sectional (side) view generally corresponding to the line 4—4 of FIG. 1, again with parts shown in their separated positions.

Referring more particularly to FIGS. 1 and 4, reference numeral 20 generally indicates a two piece, fully separable die set such as used in a punch press machine for punching holes in metallic workpieces. The die set 20 is comprised of an upper die set half 22 and a lower die set half 24. Upper die set half 22 is comprised of several metallic component parts including an upper carrier block 26. Plural keys 28 are suitably fastened by bolts 29 within a keyway 30 formed on the top surface of upper carrier block 26, the keys 28 being used to mount the upper die set half 22 to the press ram of a suitable hydraulic or mechanical brake press (not shown). Plural headed stripper bolts 32 are freely slidable within shouldered guide bores 34 formed in block 26 and are also threaded into movable die block 36 forming a well known lost motion connection therebetween. The upper half 22 also comprises plural stripper compression springs 38 seated in suitable plural facing recesses 39, 39′ formed respectively in carrier block 26 and die block 36, the springs 38 tending to maintain the upper die set half 22 in its full extension as seen in FIGS. 1, 2, and 4.

Demountably fastened by suitable bolts 40 and snuggly seated and mounted within recess 42 (the latter formed in die block 36), is an upper die insert 44. A tubular workpiece receiving groove 46 is formed within the lower face of upper die insert 44 and extends along the longitudinal length thereof. A chamfered edge 48 is formed around the lower peripheral edge of upper die insert 44 the purpose of which will be described later herein. A head type punch or perforator 50 is rigidly mounted to block 26 between a socket set screw 51 and a shoulder of a central bore 52 of carrier block 26 through which punch 50 extends. The latter also extends into and is alignedly and slidably guided by guide bores 54 and 55, respectively formed in die block 36 and in upper die insert 44. Bores 52, 54, and 55 are so formed as to be in coaxial alignment with one another for effecting accurately guided punch reciprocation, to be discussed later herein. It is deemed preferable if block 36, perforator 50, and die insert 44 are formed of a material of sufficient hardness to withstand extremely high cyclic punching operations.

Figure 5:
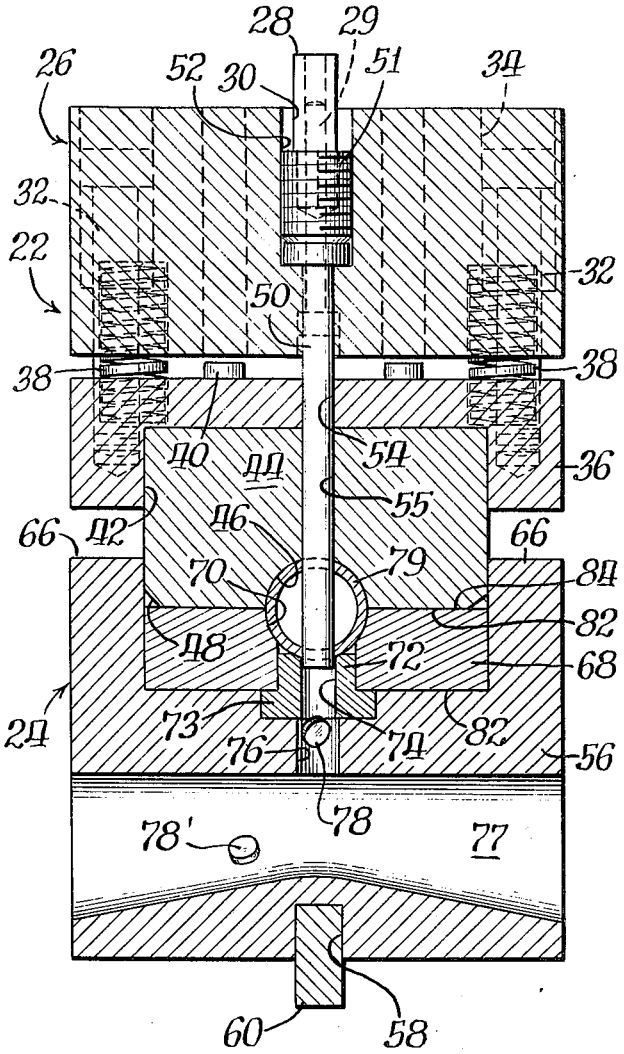
FIG. 5 is a sectional (front) view generally corresponding to line 5—5 of FIG. 2, but showing certain parts in their operationally compressed positions.

Now turning to the component parts of the lower die set half 24, there is included a base carrier block 56 having formed thereon a keyway 58 in which a key 60 is suitably secured by bolts 62. Key 60 is used to rigidly secure lower half 24 to the brake press' bed (not shown). As best seen in FIGS. 1 and 2, side plates 64 are suitably securely mounted (such as by fasteners 65) to base block 56 to form, along with the vertically projecting sides 66 of base carrier block 56, a lower die recess 67 in which a lower die insert 68 can be securely seated. A further significant function of recess 67 will be described later herein. The lower die insert 68 has a tubular workpiece groove 70 formed therein which is axially aligned and of similar configuration to the tubular workpiece receiving groove 46 of upper die insert 44. A die button 72 (FIGS. 3, 4 and 5) is rigidly retained in any well known manner, such as by vertical entrapment of a flange 73 formed on insert 72 between die insert 68 and carrier block 56. The button 72 has a central cutting bore 74 which communicates with a slug exit 76 and then with a discharge opening 77 (both formed in base carrier block 56) for the non-interferring discharge of punched workpiece slugs, such as slugs 78, 78′ of workpiece 79.

In operation, separable die set 20 is placed in its separated position as shown in FIGS. 1, 2, and 4, by raising the punch press ram (not shown). This enables the press operator or an automatic workpiece feed (not shown), to insert a tubular workpiece in lower die half 24 so as to seat within groove 70 of die insert 68. It is to be understood that other workpiece configurations, such as rectangular or square tubular sections, can be easily perforated by a punch press die set utilizing the nestable die alignment apparatus of this invention by merely changing over from the upper and lower die inserts 44, 68 to other die inserts having the desired workpiece receiving groove configuration rather than that of grooves 46, 70. Similarly, side plates 64 would necessarily have to be changed if the side plate openings 80 (FIGS. 1 and 4) were not compatible with the other workpiece's configuration. It should also be noted that any side plate opening 80 will preferably have a slightly larger opening than that of the respective workpiece receiving groove 70 (see FIGS. 1, 3, and 4) to allow for ease of entry and exit of the workpiece within the respective groove.

Once the workpiece 79 has been inserted (FIG. 4), the press can be actuated, whereby upper die set half 22 is rapidly and forcibly lowered for engagement with lower half 24. As upper half 22 approaches lower half 24, the outer periphery of projecting upper die insert 44 (the latter under lateral alignment via the chamfered leading edge 48) nestably engages the recess 67 formed by the inner periphery of plates 64 and the vertical sides 66 of carrier block 56. Regardless of the play or freedom (within limits) in the ram slide of the brake press, the leading chamfered edge 48 will affect lateral guiding of the die insert 44 until it is adequately seated within the nesting recess 66. Further lowering of upper half 22 continues such nestable slidable reception of upper die insert 44 within lower die set half 24 until lower suface 82 of die insert 44 seats against upper surfaces 84 of lower die insert 68. At such time, the workpiece 79 has been positioned and securely clamped by the grooves 46 and 70 and is in position for punching. Continued downward movement of the press ram causes the upper carrier block to partially compress the stripper springs 38 while causing the slidably guided punch 50 to pierce the workpiece's upper wall and then continue therethrough to punch its lower wall, thereby ejecting the slugs 78, 78′ into slug exit 76 and discharge opening 77.

It is to be understood that the press' shut-height will be so adjusted that once the punch 50 has pierced the workpiece's lower wall and extended into and through die button 72 (whereupon the press' punching cycle is completed and the press ram can be automatically raised), no further movement of upper carrier block 26 toward die block 36 will occur, thereby assuring that no undesirable forcible engagement occurs therebetween. Stripper springs 38 work in the commonly known method of effecting extraction of punch 50 from the punched workpiece by causing die block 36 and die insert 44 to be extended away from carrier block 26, and the punch 50 removably carried thereby, while upper die set half 22 is travelling upwards to the fully extended position shown in FIG. 1 for the next cycle.

It is to be noted that during punching of the workpiece's lower wall, the punch 50 is coaxially aligned with cutting base 74 of die button 72. This is because upper die insert 44 is perfectly aligned and positioned above lower die insert 68 through the nestable alignment provided between die insert 44 and the recess 67 formed by plates 64 and sides 66 on block 56. It is further because the guide bore 55 and die button 72 are in central alignment within their respective die inserts. Such accurate die insert-to-insert and punch-to-die button alignment assures that no workpiece burr buildup occurs, nor is there any possibility of chipping of the punch or die button due to their respective misalignment.

The use of respectively projecting and recessed die inserts as disclosed herein provides a punch press die set with accurate alignment means without the use of any auxiliary alignment means such as the mating pins and holes of the prior art. Because the self-aligning mating components of the nestable die alignment apparatus of this invention are preferably formed of a hardened metal, there is no appreciable wear under continuous cyclic operation. Moreover, because of the relatively large circumferential bearing area for alignment purposes (compared to prior art devices) provided between the respective vertical sides of the upper die insert 44 and of the nesting cage or recess 67 of the lower die set half 24, there is minimum, if any, wear of the nestable die alignment apparatus of the present invention. Thus, the aforementioned accurate punch-to-die button alignment, as well as reduction in repair down time, is further assured.

From the foregoing, it is believed that those skilled in the art will readily appreciate the unique features and advantages of the present invention over previous types of alignment means for punch press die sets. Further, it is to be understood that while the present invention has been described in relation to a particular preferred embodiment as set forth in the accompanying drawings and as above described, the same nevertheless is susceptible to change, variation and substitution of equivalents without departure from the spirit and scope of this invention. It is therefore intended that the present invention be unrestricted by the foregoing description and drawings, except as may appear in the following appended claims.

The embodiments of the invention in which an exclusive property or privilege is claimed are defined as follows:

1. Alignment apparatus for punch press machines of the type having separable die set halves, a first die set half being affixed for reciprocal operative movement with the punch press ram and a second die set half being affixed to the press bed, each die set half comprising die carrier block means and demountable die insert means, the latter cooperatively operable to position a workpiece during punching thereof, punch means, and workpiece stripper means, the alignment apparatus comprising in combination:

projecting die insert means secured to one die set half and extending therefrom toward the other die set half, said projecting die insert means presenting alignment means formed on the outer periphery thereof; nesting means carried by the die carrier block means of the other die set half and formed about the die insert means thereof, said nesting means extending toward said projecting die insert means of said one die set, thereby providing a nesting recess characterized by an inner periphery operable to nestably receive said alignment means when said die set halves are forcibly engaged, whereby the operational alignment of said die inserts of said die set halves is assured.

2. Die alignment apparatus for use in reciprocable workpiece piercing machines of the type having fully separable die set halves, punch means, and workpiece stripper means, and wherein each die set comprises a die insert and a carrier block, each said die insert means having punch aperture means and workpiece positioning means formed thereon, the die alignment apparatus comprising in combination:

die insert means mounted on the carrier block of one die set half and projecting toward the other die set half;

male alignment means formed by the outer periphery of said projecting die insert means;

female nestable alignment means mounted on the carrier block of said other die set half and extending toward said one die set half, said female nestable alignment means having an inner periphery formed to matingly receive said male alignment means, whereby concentric alignment of the punch aperture means on each die insert means and the accurate positioning, clamping, and punching of a workpiece is assured when said die set halves are cyclically engaged.

3. The invention of claim 2, and wherein said die insert means are releasably mounted to their respective said carrier blocks.

* * * * *